US011647856B1

(12) United States Patent
Jiu

(10) Patent No.: US 11,647,856 B1
(45) Date of Patent: May 16, 2023

(54) ADAPTOR DEVICE FOR A LID

(71) Applicant: Evelyn Jiu, Martinez, CA (US)

(72) Inventor: Evelyn Jiu, Martinez, CA (US)

( * ) Notice: Subject to any disclaimer, the term of this patent is extended or adjusted under 35 U.S.C. 154(b) by 0 days.

(21) Appl. No.: 17/721,224

(22) Filed: Apr. 14, 2022

(51) Int. Cl.
*A47G 19/22* (2006.01)

(52) U.S. Cl.
CPC ..... *A47G 19/2272* (2013.01)

(58) Field of Classification Search
CPC ..... A47G 19/2272; A47G 19/2266; A47G 21/185; A47G 21/182; A47G 21/18; B65D 77/283
USPC ..... 220/712, 711, 709, 707, 705; 215/229, 215/228, 389, 388
See application file for complete search history.

(56) References Cited

U.S. PATENT DOCUMENTS 4,438,865 A * 3/1984 Scattaregia ..... B65D 43/0268 220/254.1
5,025,947 A * 6/1991 Leone ..... B65D 47/36 220/709
8,978,907 B2 * 3/2015 Greenberg ..... A47G 19/2222 206/427
2005/0139603 A1 * 6/2005 Lee ..... B65D 5/746 220/705
2007/0039958 A1 * 2/2007 Henderson ..... B65D 43/0212 220/780
2007/0062943 A1 * 3/2007 Bosworth, Sr. ..... B65D 51/28 220/780
2008/0190945 A1 * 8/2008 Milnark ..... A47G 19/2211 220/709
2022/0151411 A1 * 5/2022 Savenok ..... A47G 19/2288

FOREIGN PATENT DOCUMENTS

GB 2416765 A * 2/2006 ..... A47G 19/2266

* cited by examiner

*Primary Examiner* — Robert J Hicks
(74) *Attorney, Agent, or Firm* — Theodore J. Bielen, Jr.

(57) ABSTRACT

An adaptor device for a lid used with a container, including a disc. The disc substantially occupies a portion of the lid such that a straw is able to pass through the disc and through the lid into a container holding a potable liquid. The disc substantially encloses an opening through the lid.

9 Claims, 2 Drawing Sheets

ADAPTOR DEVICE FOR A LID

BACKGROUND OF THE INVENTION

The present application relates to a novel and useful adaptor device for a lid found on beverage containers.

Beverages are normally dispensed in a disposable container. Such containers are typically enclosed by a snap-fitting lid having an opening to allow the passage of a straw into the chamber of the container.

Such opening through the lid to the container chamber constitutes a loose fitting in conjunction with a straw, since a number of flexible flaps surround the opening. This structure results in multiple openings from the exterior of the lid to the chamber of the container when the straw is in place. Unfortunately, such openings allow the passage of air from the outside of the container chamber to the chamber itself. Also, such openings permit the incursion of insects and debris to the contents of the chamber when the user of the straw has placed the container in a rest position. Needless to say, such access to the contents of the chamber of the container through the lid opening results in an unsanitary conditions.

An adapter for the lid of a disposable container permitting strict access to the chamber of the container when in use would be a notable advance in the food handling field.

SUMMARY OF THE INVENTION

In accordance with the present application, a novel and useful adaptor device for a container lid is herein provided.

Typically, the lid for a disposable container includes a recess with a floor or base that extends transversely across the lid. An opening through the lid base also includes a plurality of flexible flaps that are adjacent the opening. Such flexible flaps are merely pushed aside when a straw is extended through the opening, leaving apertures adjacent the flaps that permit detrimental access to the chamber of the container.

The device of the present application includes a disc that possesses a thickness and a transverse dimension to substantially occupy the recess of the base of the lid. Further, the disc also includes a mass capable of exerting a confining force on the lid that holds the disc against the base of the lid within the recess of the lid. Moreover, the disc is also constructed with an aperture through the same that aligns with the opening through the lid.

A straw is also included in the adaptor device of the present application. The straw possesses an outer surface having a transverse dimension which is adapted to permit snug passage of the straw through the aperture of the disc as well as a tight passage through the lid opening. Such straw passage folds the flexible flaps adjacent the lid opening toward the wall of the container within the chamber of the container.

In certain cases, the disc comprises a rounded perimeter and is formed of a transparent material. Moreover, the straw may include a rounded outer surface, which is essentially cylindrical in configuration. Once the straw is in place through the disc aperture and through the lid opening, the straw perimeter substantially occupies the entire opening through the base of the lid and folds the flexible flaps adjacent the lid opening through the lid toward the wall of the container within the chamber of the container. In essence, the resultant employment of the disc and straw od the device of the present application substantially seals the lid relative to the chamber of the container.

It may be apparent that a novel and useful adaptor device for the lid of a disposable container has been described.

It is therefore an object of the present application to provide and adaptor device for a lid of a disposable container that effectively seals the chamber of the container when a user is accessing the liquid contents of the disposable container.

Another object of the present application is to provide an adaptor device for a lid of a container which utilizes a disc having an aperture therethrough and a straw which snugly fits through the aperture such that the perimeter of the straw occupies the opening through the base of the lid when in use.

Another object of the present application is to provide an adaptor device for a lid having a recess which comprises a transparent body.

Another object of the present application is to provide an adaptor device for a lid used with a disposable container which possesses sufficient durability to allow reuse over time.

Another object of the present application is to provide an adaptor device for a lid which results in the maintenance of a sanitary condition of the liquid contents of the disposable container used with the lid.

The application possesses other objects and advantages especially as concerns particular features thereof which will become apparent as the specification continues.

For a better understanding of the application, reference is made to the following detailed description of the preferred embodiments thereof which should be taken in conjunction with the prior described drawings.

DETAILED DESCRIPTION OF THE PREFERRED EMBODIMENTS

Various aspects of the present application will evolve from the following detailed description of the preferred embodiments thereof which should be taken together with the prior delineated drawings.

Figure 1:
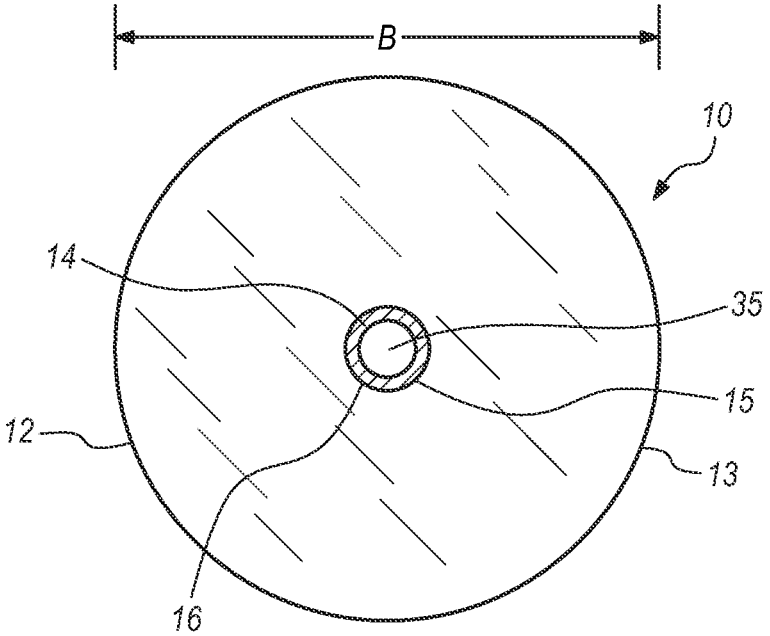
FIG. 1 is a top plan view of the disc portion of the device of the present application with the straw portion shown in section.

The device as a whole is shown in the drawings by reference character 10. The adaptor device 10 includes a rounded disc 12 and a straw 14 which snugly passes through an aperture 16 in disc 12, FIG. 1.

Figure 2:
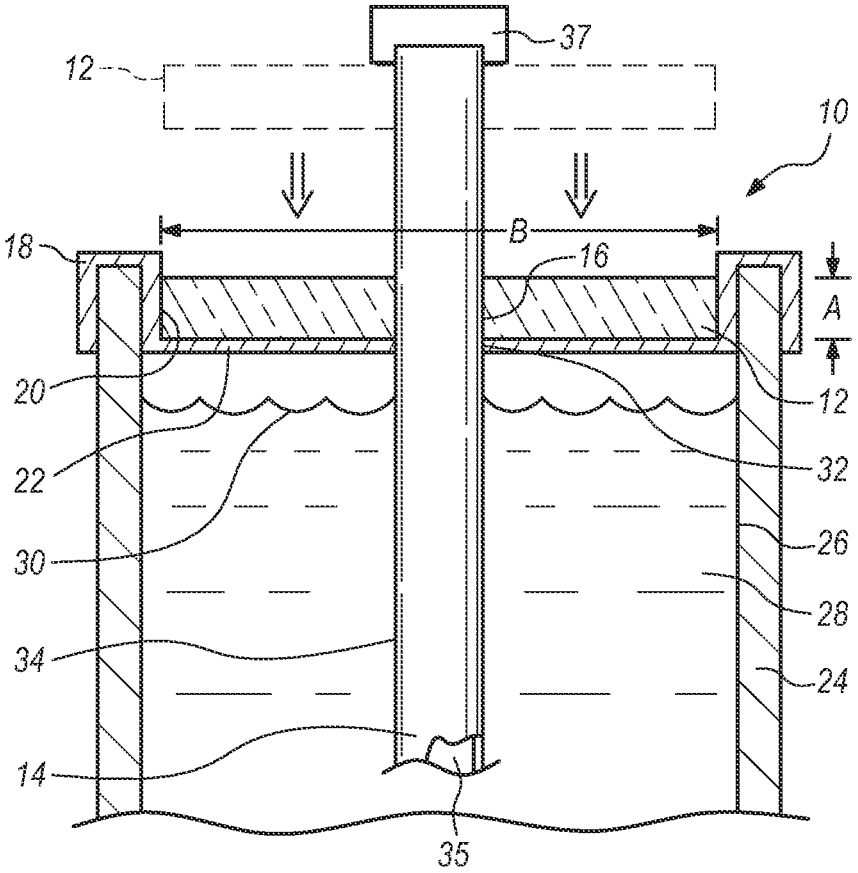
FIG. 2 is a sectional view of a container having a lid with the device of the present application in place atop the lid.

With reference to FIG. 2, it may be observed that disc 12 possesses a thickness dimension "A" and a transverse dimension "B". Disc 12 may be formed of a rigid or semi rigid material, such as a transparent polymeric material, and possesses a rounded perimeter 13.

Viewing again FIG. 2, it may be seen that device 10 is employed with a lid 18 having a recess 20. Lid 18 also includes a floor or base 22. Lid 18 is employed with a container 24 which may be a disposable container. Container 24 has a wall portion 26 that forms a chamber 28 intended to hold liquid 30, which may be a consumable liquid. As shown in FIG. 2, disc 12 with a thickness dimension "A" and a transverse dimension "B" substantially occupies recess 20 of lid 18. The mass or weight of disc 12 is sufficient to exert a confining force on lid 18 on top of container 24. Disc 12 lies immediately against base or floor 22 of lid 18 such that aperture 16 through disc 12 aligns with an opening 32 through lid 18.

Straw 14 is also found in device 10 and includes an outer surface 34 and a central channel 35. Cap 37 may be employed to enclose channel 35 when straw 14 is not being used. Straw 14 is also fashioned with a rounded perimeter 15 sufficient to permit the snug passage of straw 14 through aperture 16 of disc 12 as well as lid opening 32. Straw 14 of device 10 is larger than conventional straw 44, described hereinafter.

Figure 3:
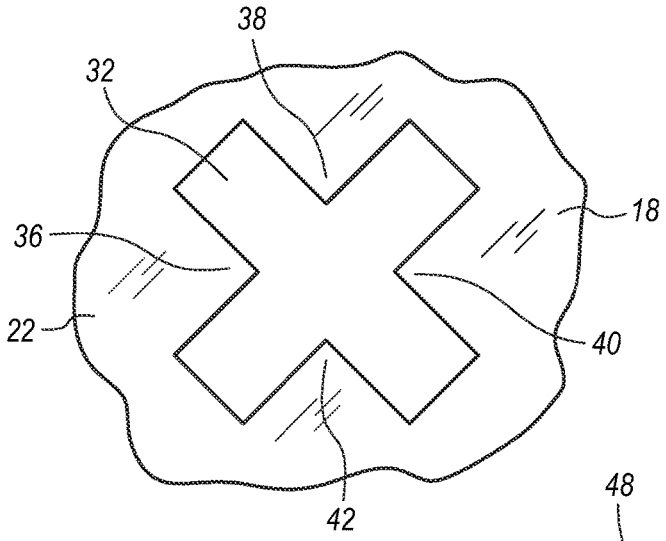
FIG. 3 is a partial plan view of a lid showing an opening through the lid.

With reference to FIG. 3, it may be seen that the opening 32 through the base of lid 18 is formed with flexible flaps 36, 38, 40, and 42. Such flaps lie adjacent opening 32.

Figure 4:
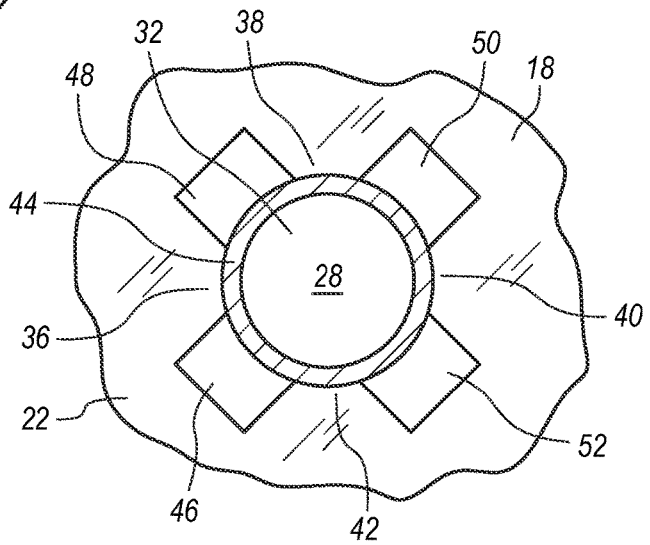
FIG. 4 is a top plan view of the lid showing the opening through the lid when used with a conventional straw.

Turning to FIG. 4, it may be observed that a conventional straw 44 has been passed through opening 32 of lid 18 and has partially folded back flexible flaps 36, 38, 40, and 42. However, the use of conventional straw 44 at lid opening 32 leaves passageways 46, 48, 50, and 52 to chamber 28 of container 24. The formation of passageways 46, 48, 50, and 52 are undesirable and allows the ingress of items such as insects, dirt, microbes, and the like to chamber 24 of container 24. This is especially true when straw 44 is not employed by a user to draw liquid 30 from chamber 28 of container 24.

Figure 5:
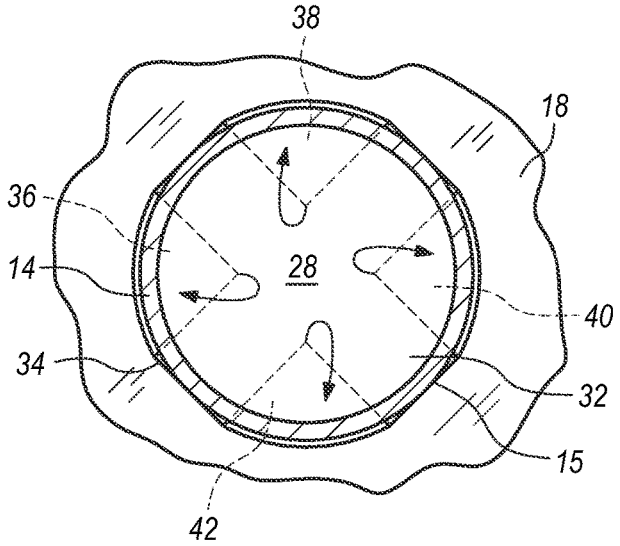
FIG. 5 is a top plan view of the lid with the straw portion of the device occupying the opening through the lid and illustrating the folding of the flaps surrounding the lid opening.

FIG. 5 represents the adaption of device 10 to lid 18 and container 24 where straw 14, having snugly passed through aperture 16 of disc 12, also passes through aperture 32 of lid 18. In doing so, the outer surface 34 of the perimeter of straw 14 folds or presses flaps 36, 38, 40, and 42 toward the wall portion 26 of container 24. Directional arrows on FIG. 5 illustrate such folding.

Figure 6:
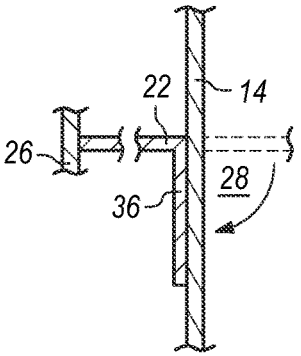
FIG. 6 is a sectional view showing the folding of a flap surrounding the opening through the lid toward the wall portion of the container by the straw portion of the device of the present application.

FIG. 6 shows the typical folding of flap 36 toward wall portion 26 of container 24 by straw 14 outer surface 34.

In operation, the user places disc 12 atop lid 18 and within recess 20 thereof. Disc 12 substantially occupies recess 20 in this endeavor. Straw 14 is then snugly passed through aperture 16 of disc 12 and opening 32 of lid 18. Straw snugly fits through aperture 16 and opening 32 and, in doing so, folds or presses flaps 36, 38, 40, and 42 toward wall 26 of container 24. The outer surface 34 of straw 14 then substantially occupies opening 32 through lid 18 and substantially seals the same, not allowing extraneous material through opening 32 and into chamber 28 of container 24. This leaves the only access to chamber 28 of container 24 through passageway 35. Cap 37 may be employed to enclose passageway 35 when straw 14 is idle.

While in the foregoing embodiments of the application have been set forth in considerable detail for the purposes of making a complete disclosure of the application, it may be apparent to those of skill in the art that numerous changes may be made in such details without departing from the spirit and principles of the application.

What is claimed is:

1. An adaptor device for a lid having a recess and a base spanning the recess and an opening through the base, the base having a plurality of flexible flaps adjacent the opening, for use with a container having a wall portion forming a chamber, the adaptor device comprising:

a disc, said disc possessing a thickness and a transverse dimension to substantially occupy the recess of the lid, said disc further possessing a mass capable of exerting a confining force on said lid for holding said disc against said base and within the recess of the lid, said disc further comprising an aperture therethrough aligning with the opening through the lid; and a straw, said straw including a channel and an outer surface having a transverse dimension adapted to permit snug passage of said straw through said aperture of said disc and permitting passage through the lid opening and folding of the flexible flaps adjacent the lid opening toward the wall of the container within the chamber of the container.

2. The device of claim 1 in which said straw outer surface is sized to completely occupy the opening through the base of the lid.

3. The device of claim 1 in which said disc further comprises a rounded perimeter.

4. The device of claim 3 in which said straw outer surface comprises a rounded outer surface.

5. The device of claim 1 in which said disc comprises a transparent member.

6. The device of claim 5 in which said straw is sized to completely occupy the opening through the base of the lid.

7. The device of claim 5 in which said disc further comprises a rounded perimeter.

8. The device of claim 7 in which said straw outer surface comprises a rounded outer surface.

9. The device of claim 5 which additionally comprises a cap to enclose said channel of said straw.

* * * * *